US007535423B2

(12) United States Patent
Lin et al.

(10) Patent No.: US 7,535,423 B2
(45) Date of Patent: May 19, 2009

(54) MULTIPLE-BAND MONOPOLE COUPLING ANTENNA

(75) Inventors: Ching-Chi Lin, Taipei-Hsien (TW); Kai Shih, Taipei-Hsien (TW); Yu-Yuan Wu, Taipei-Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 199 days.

(21) Appl. No.: 11/552,943

(22) Filed: Oct. 25, 2006

(65) Prior Publication Data

US 2008/0100515 A1 May 1, 2008

(51) Int. Cl.
*H01Q 1/24* (2006.01)

(52) U.S. Cl. ..... 343/702; 343/700 MS; 343/729

(58) Field of Classification Search ..... 343/702, 343/725, 729, 728, 700 MS
See application file for complete search history.

(56) References Cited

U.S. PATENT DOCUMENTS 6,552,686 B2 * 4/2003 Ollikainen et al. .... 343/700 MS
7,126,545 B2 * 10/2006 Nagano et al. ..... 343/702
2002/0149527 A1 * 10/2002 Wen et al. ..... 343/727
2005/0093750 A1 * 5/2005 Vance ..... 343/702
2005/0259010 A1 * 11/2005 Soutome ..... 343/702
2006/0049990 A1 * 3/2006 Watada et al. ..... 343/700 MS
2007/0069958 A1 * 3/2007 Ozkar ..... 343/700 MS
2007/0210969 A1 * 9/2007 Vance ..... 343/702

* cited by examiner

*Primary Examiner*—HoangAnh T Le
(74) *Attorney, Agent, or Firm*—WPAT, P.C.; Anthony King

(57) ABSTRACT

A multiple-band monopole coupling antenna includes a dielectric board, a low frequency antenna and a high frequency antenna. The low frequency antenna and the high frequency antenna are located on the front of the dielectric board. The length of the low frequency antenna equals to the half length of the low frequency waves and can receive and transmit two low frequency waves and a high frequency wave. The length of the high frequency antenna equals to the quarter length of the high frequency waves. The high frequency antenna is adjacent to the low frequency antenna and couples with the low frequency antenna while the low frequency antenna is receiving or transmitting signal. Thus, the high frequency antenna can receive and transmit three high frequency waves. The multiple-band monopole coupling antenna can receive and transmit all frequency bands, which are used in the mobile communication.

6 Claims, 4 Drawing Sheets

MULTIPLE-BAND MONOPOLE COUPLING ANTENNA

BACKGROUND OF THE INVENTION

1. Field of the Invention

This present invention relates generally to an antenna for transmitting and receiving radio frequency signals, and more particularly to a multiple-band monopole coupling antenna operating over a wide bandwidth of frequencies or over multiple frequency bands.

2. The Related Art

It is generally known that antenna performance is dependent upon the size, shape and material composition of the constituent antenna elements, as well as the relationship between certain antenna physical parameters and the wavelength of the signal received or transmitted by the antenna.

As the mobile phone is popular, the mobile phone is required to be small and light. Thus, the antenna as a part of the mobile phone is needed to small area and receiving/transmitting all the frequency bands of the mobile communication. Because different countries in the world are using different mobile communication system, such as the GSM, PHS, DCS Wi-Fi or PCS communication system, different antenna are required to fit into the mobile phones.

A traditional antenna which is fit in a mobile phone can be used in one or two communication systems, so the mobile phone cannot used in every country in the world. The mobile phone cannot be small and light, as a reason the traditional antenna located the mobile phone has a large area.

SUMMARY OF THE INVENTION

An object of the invention is to provide a multiple-band monopole antenna includes a dielectric board, a low frequency antenna and a high frequency antenna. The low frequency antenna and the high frequency antenna are located on the dielectric board, and the high frequency antenna is adjacent to the low frequency antenna. The length of the low frequency wire equals to the half wavelength of the low frequency waves which are used in mobile communication, so the low frequency antenna can receive and transmit GSM850, GSM and Wi-Fi. The length of the high frequency antenna equals to the high frequency waves which are used in mobile communication. While the low frequency antenna is receiving or transmitting signal, the high frequency antenna coupling with the low frequency antenna, so the high frequency antenna can receive and transmit DCS, PCS and WCDMA-2100. So the multiple-band monopole antenna can receive and transmit all frequency waves, which are used in the mobile communication.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
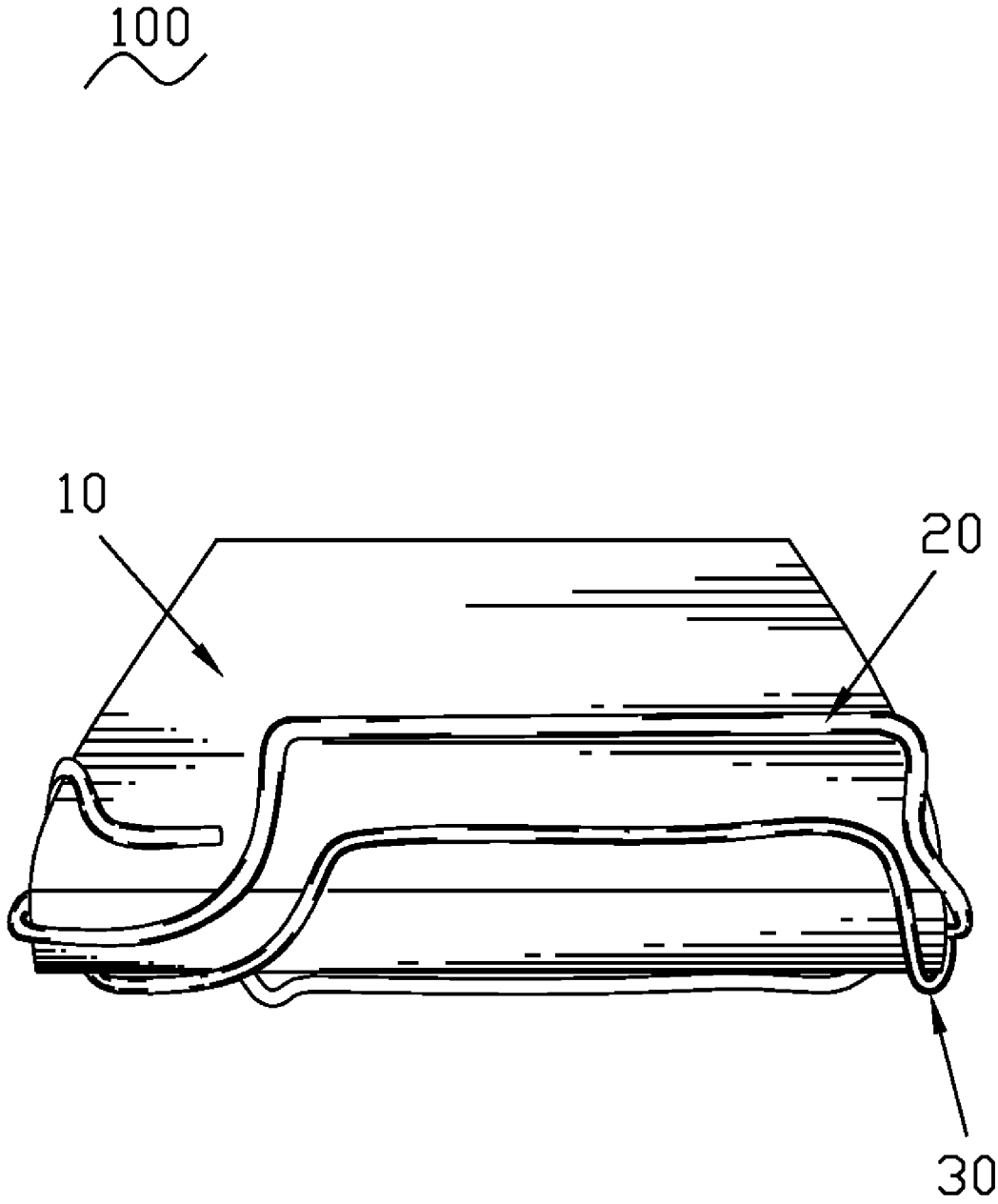
FIG. 1 is a front view of a multiple-band monopole antenna according to the present invention.

First referring to FIG. 1, a multiple-band monopole antenna 100 according to the invention is shown. The multiple-band monopole antenna 100 comprises a dielectric board 10, a low frequency antenna 20 and a high frequency antenna 30. The low frequency antenna 20 and the high frequency antenna 30 are located in the front of the dielectric board 10.

Figure 2:
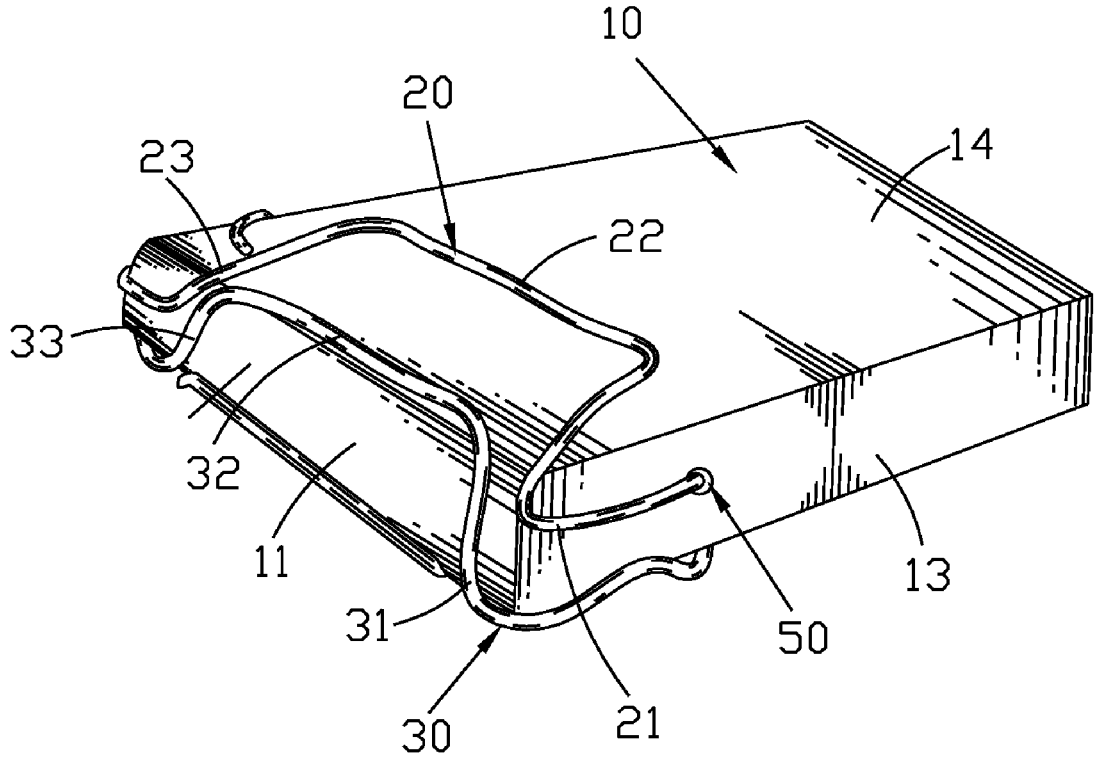
FIG. 2 is a right lateral view of the multiple-band monopole antenna.
Figure 3:
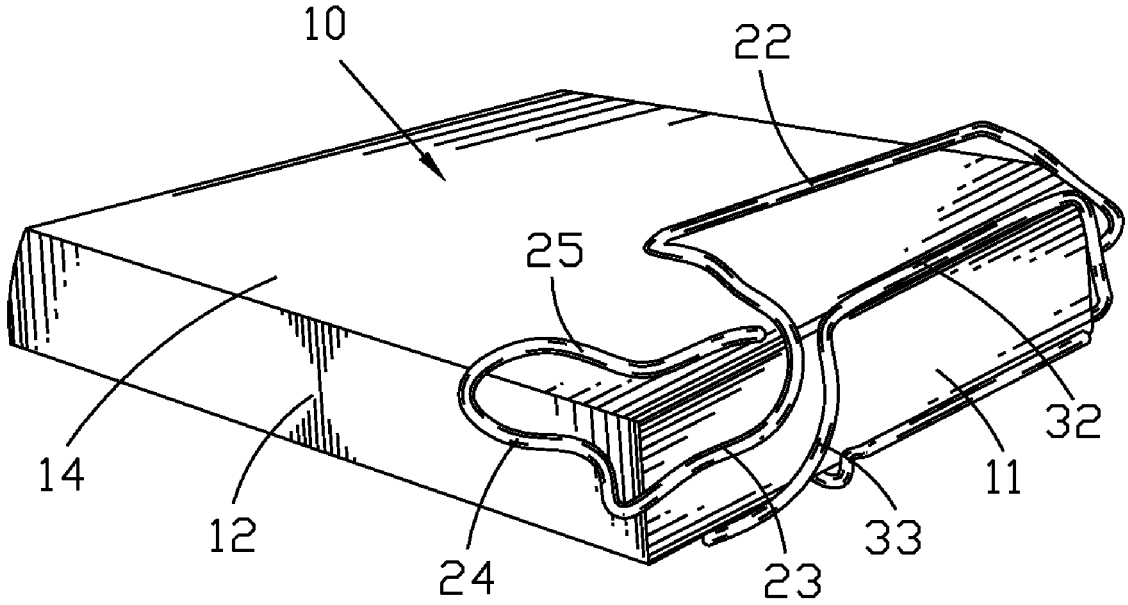
FIG. 3 is a left lateral view of the multiple-band monopole antenna.

Referring to FIG. 2 and FIG. 3, the low frequency antenna 20 includes a first fold wire 21, a straight wire 22, a second fold wire 23, a third fold wire 24 and a fourth fold wire 25. The first fold wire 21 is located on the right side 13 of the dielectric board 10. A signal feed point 50 is formed on the right side 13 and the back end of the first fold wire 21 connects to the signal feed point 50. The straight wire 22 is located on the upper side 14 of the dielectric board 10. The front end of the straight wire 22 connects with the front end of the first fold wire 21 in an area between the right side 13 and the upper side 14 connection. The front of the second fold wire 23 is located on the upper side 14. The end of the second fold wire 23 is located on the front side 11 of the dielectric board 10. The front end of the second fold wire 23 connects to the end of the rear end of the straight wire 22. The third fold wire 24 is located on the left side 12 of the dielectric board 10. The front end of the third fold wire 24 connects to the rear end of the second fold wire 23. The fourth fold wire 25 is arranged on the upper side 14. The rear end of the fourth fold wire 25 connects to the rear end of the third fold wire 24, the fourth fold wire 25 does not connects to the straight wire 22 or the second fold wire 23. The first fold wire 21, the straight wire 22, the second fold wire 23, the forth wire 24 and the fourth fold wire 25 connects orderly and formed the low frequency antenna 20.

The low frequency antenna 20 is a monopole antenna. The length of the low frequency antenna 20 equals to the half length of the low frequency wave, which is used in the mobile communication.

Figure 4:
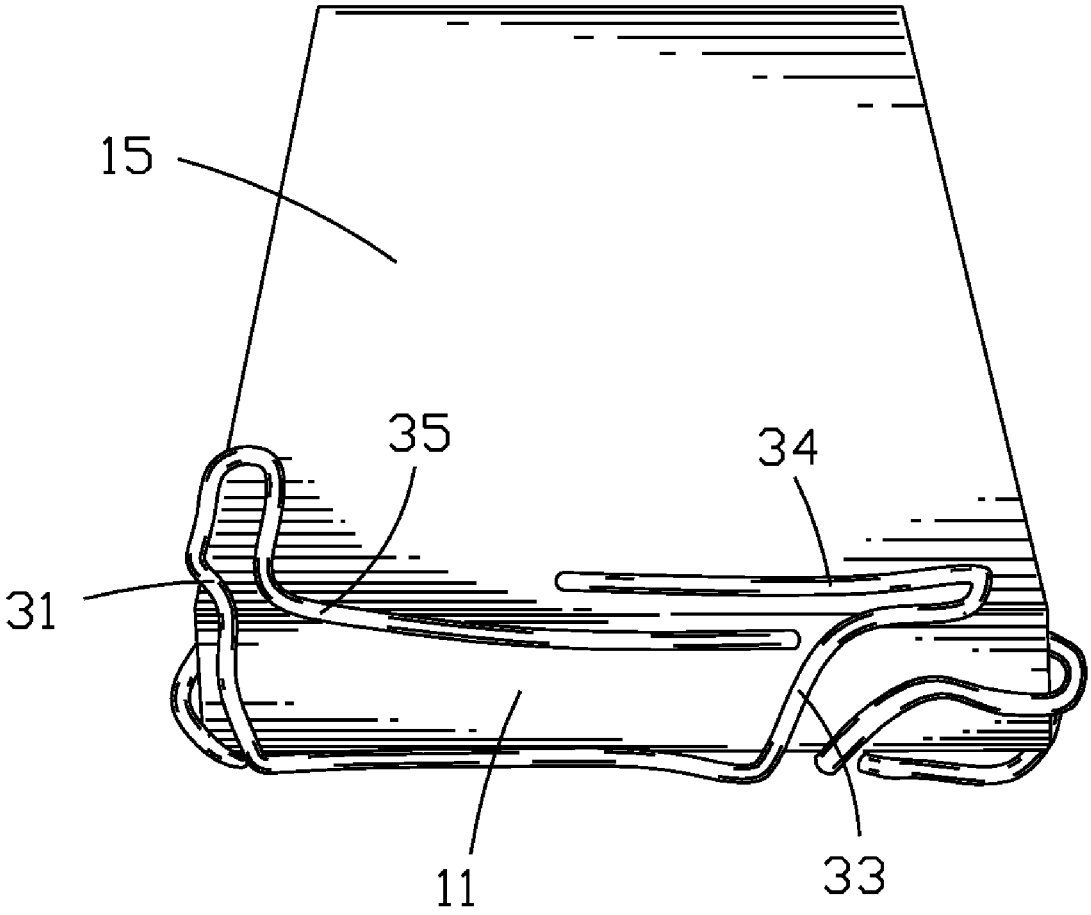
FIG. 4 is an end view showing a portion of a high frequency wire of the multiple-band monopole antenna.

Please refer to FIG. 2 and FIG. 4, the high frequency antenna 30 includes a sixth fold wire 31, an unbent wire 32, a seventh fold wire 33, a rectilinear wire 34 and an eighth fold wire 35. The sixth fold wire 31 is located on the right side 13 of the dielectric board 10, and the sixth fold wire 31 is adjacent to the first fold wire 21. The unbent wire 32 is located on the front side 11 of the dielectric board 10. The front end of the unbent wire 32 connects to the rear end of the sixth fold wire 31. The seventh fold wire 33 formed on the front side 14 of the dielectric board 10. The front end of the seventh fold wire 33 connects to the rear end of the unbent wire 32. The rectilinear wire 34 is arranged in the under side 15 of the dielectric board 10. The front end of the rectilinear wire 34 connects to the rear end of the seventh fold wire 33. The front of the eighth fold wire 35 is formed on the right side 11. The rear of the eighth fold wire 35 is located in the under side 15 of the dielectric board 10. The front end of the eighth fold wire 35 connects to the rear end of the sixth fold wire 31.

The high frequency antenna 30 is a monopole antenna. The length of the high frequency antenna 30 equals to the quarter length of the high frequency waves, which are used in the mobile communication.

While the multiple-band monopole antenna 100 is working, the low frequency antenna 20 can receive and transmit two low frequency waves (GSM850 and GSM), and the low frequency antenna 20 can receive and transmit a high frequency wave (Wi-Fi) by resonancing. The widthbands of the two low frequency waves were changed by changing the length of the straight wire 21. While the fourth fold wire 25 is short, the low frequency antenna 20 trends to receive and transmit the high frequency portion of the two low frequency waves (GSM850 and GSM). While the fourth fold wire 25 is long, the low frequency antenna 20 trends to receive and transmit the low frequency portion of the two low frequency waves (GSM850 and GSM). The high frequency antenna 30 is adjacent to the low frequency antenna 20, so the high frequency antenna 30 coupling with the low frequency antenna 20, the high frequency antenna 30 can receive and transmit three high frequency waves (DCS, PCS and WCDMA-2100). While the straight wire 22 of the low frequency antenna 20 is adjacent to the unbent wire 32 of the high frequency antenna 30, the high frequency antenna 30 trends to receive and transmit the high frequency portion of the high frequency waves (DCS, PCS and WCDMA-2100). While the straight wire 22 of the low frequency antenna 20 keep away from the unbent wire 32 of the high frequency antenna 30, the high frequency antenna 30 trends to receive and transmit the low frequency portion of the three high frequency waves (DCS, PCS and WCDMA-2100).

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A multiple-band monopole coupling antenna mounted into an electronic device, comprising:

a dielectric board, a signal feed point located on the right side of the dielectric board;

a low frequency antenna located on the dielectric board, one end of the low frequency antenna connects to the signal feed point, the length of the low frequency antenna matches the half length of low frequency waves which are used in the mobile communication; and a high frequency antenna located on the dielectric board and adjacent to the low frequency antenna, the length of the high frequency antenna equal to the length of the high frequency waves which are used in the mobile communication;

wherein the low frequency antenna comprises a first fold wire, a straight wire, a second fold wire, a third fold wire and a fourth fold wire, the first fold wire located on the right side of the dielectric board, the back end of the first fold wire connects to the signal feed point, the straight wire located on the upper side of the dielectric board, the front end of the straight wire connects with the front end of the first fold wire, the front of the second fold wire located on the upper side, the end of the second fold wire located on the front side of the dielectric board, the front end of the second fold wire connects to the end of the rear end of the straight wire, the third fold wire located on the left side of the dielectric board, the front end of the third fold wire connects to the rear end of the second fold wire, the fourth fold wire arranged on the upper side, the rear end of the fourth fold wire connects to the rear end of the third fold wire, the fourth fold wire never connects to the straight wire or the second fold wire.

2. The multiple-band monopole coupling antenna as set forth in claim 1, wherein the high frequency antenna comprises a sixth fold wire, an unbent wire, a seventh fold wire, a rectilinear wire and an eighth fold wire, the sixth fold wire located on the right side of the dielectric board, and the sixth fold wire adjacent to the first fold wire, the unbent wire located on the front side of the dielectric board, the front end of the unbent wire connects to the rear end of the sixth fold wire, the seventh fold wire formed on the front side of the dielectric board, the front end of the seventh fold wire connects to the rear end of the unbent wire, the rectilinear wire located in the under side of the dielectric board, the front end of the rectilinear wire connects to the rear end of the seventh fold wire, the front of the eighth fold wire formed on the right side, the rear of the eighth fold wire located in the under side of the dielectric board, the front end of the eighth fold wire connects to the rear end of the sixth fold wire.

3. A coupling antenna comprising:

a dielectric board, a signal feed point located on said dielectric board;

an first antenna disposed on said dielectric board, one end of said first antenna connected to said signal feed point, said first antenna resonating at a first band operating at mobile phone communication, and a second band being higher than said first band and operating at another communication except mobile phone communication; and a parasitical antenna disposed on the dielectric board and adjacent to said first antenna, said parasitical antenna electromagnetically coupling with said first antenna to resonate at a third band being higher than said first band and lower than said second band, said third band operating at mobile phone telecommunication;

wherein said first antenna has orderly connected a first fold wire, a straight wire and a second fold wire, said first fold wire connects to said signal feed point, said parasitical antenna has orderly connected a third fold wire, a unbent wire and a fourth fold wire, said first fold wire, said straight wire and said second fold wire respectively adjacent to and electromagnetically couple with said third fold wire, said unbent wire and said fourth fold wire;

wherein said first antenna has a fifth fold wire and a sixth fold wire connected to said fifth fold wire, said fifth fold wire connects to a free end of said second fold wire, said parasitical antenna has a rectilinear wire connected to a free end of said fourth fold wire, and a seventh fold wire connected to a free end of said third fold wire, a free end portion of said rectilinear wire adjacent to a freed end portion of said seventh fold wire.

4. The coupling antenna as claimed in claim 3, wherein said first antenna is a monopole antenna.

5. The coupling antenna as claimed in claim 3, wherein said first fold wire locates on a right side of said dielectric board, a back end of said first fold wire connects to said signal feed point, said straight wire locates on a upper side of said dielectric board, a front end of said straight wire connects with a front end of said first fold wire, a front portion of said second fold wire locates on said upper side, an end portion of said second fold wire locates on a front side of said dielectric board, a front end of said second fold wire connects to an end of a rear end of said straight wire, said fifth fold wire locates on a left side of said dielectric board, a front end of said fifth fold wire connects to a rear end of said second fold wire, said sixth fold wire arranges on said upper side of said dielectric board, a rear end of said sixth fold wire connects to a rear end of said fifth fold wire, said sixth fold wire separates from said straight wire and said second fold wire.

6. The coupling antenna as claimed in claim 5, wherein said third fold wire locates on said right side of said dielectric board, said unbent wire locates on said front side of said dielectric board, a front end of said unbent wire connects to a rear end of said third fold wire, said fourth fold wire locates on said front side of said dielectric board, a front end of said fourth fold wire connects to a rear end of said unbent wire, said rectilinear wire locates on an under side of said dielectric board, a front end of said rectilinear wire connects to a rear end of said fourth fold wire, a front of said seventh fold wire locates on said right side of said dielectric board, a rear end of said seventh fold wire locates on said under side of said dielectric board, a front end of said seventh fold wire connects to a rear end of said third fold wire.

* * * * *